United States Patent [19]

Aharoni et al.

[11] Patent Number: 4,963,311

[45] Date of Patent: Oct. 16, 1990

[54] POLYAMIDE/POLYESTER GRAFT COPOLYMER FIBERS AND METHOD OF PREPARING SAME

[75] Inventors: Shaul M. Aharoni, Morris Plains; Robert C. Morgan, Summit, both of N.J.

[73] Assignee: Allied-Signal, Morris Township, N.J.

[21] Appl. No.: 361,461

[22] Filed: Jun. 5, 1989

Related U.S. Application Data

[63] Continuation of Ser. No. 133,268, Dec. 17, 1987, abandoned, which is a continuation of Ser. No. 79,151, Dec. 6, 1984, abandoned.

[51] Int. Cl.[5] ..... D01D 5/12; D01F 1/02; B29C 47/88

[52] U.S. Cl. ..... 264/210.8; 264/210.6; 264/211; 264/211.12; 525/425

[58] Field of Search ..... 264/210.8, 210.6, 211, 264/211.12; 525/425

[56] References Cited

U.S. PATENT DOCUMENTS

| | | | |
|---|---|---|---|
| 3,562,357 | 2/1971 | Eichenbaum . | |
| 4,417,031 | 11/1983 | Aharoni et al. | 525/425 |
| 4,503,203 | 3/1985 | Golembeski et al. . | |
| 4,508,844 | 4/1985 | Agapiou . | |

FOREIGN PATENT DOCUMENTS

| | | | |
|---|---|---|---|
| 55-127409 | 10/1980 | Japan . | |
| 61-151204 | 7/1986 | Japan . | |
| 1141118 | 1/1969 | United Kingdom | 525/425 |

*Primary Examiner*—Ana L. Carrillo

*Attorney, Agent, or Firm*—Richard C. Stewart; Gerhard H. Fuchs; Ernest D. Buff

[57] ABSTRACT

A process for the production of graft polyester/polyamide copolymers useful in the manufacture of fibers which comprises intimately mixing derivatized polyester and suitable polyamide to form the graft copolymer, and thereafter spinning the graft copolymer into a fiber which is drawn.

32 Claims, No Drawings

POLYAMIDE/POLYESTER GRAFT COPOLYMER FIBERS AND METHOD OF PREPARING SAME

This application is a continuation of application Ser. No. 133,268 filed Dec. 17, 1987, now abandoned, which is a continuation of application Ser. No. 679,151 filed Dec. 6, 1984, now abandoned.

BACKGROUND OF THE INVENTION

1. Field of the Invention.

The present invention relates to polyamide/polyester composite fibers with polymer grafting. Another aspect of this invention relates to a method of producing such fibers.

2. Prior Art.

Fibers have previously been prepared from blends of polyamides with minor amounts of polyesters such as poly(ethylene terephthalate). Intimate mixing before and during the spinning process has been recognized as necessary to achieve good properties in such blended fibers. It is furthermore known that the fine dispersions in fibers of polymer blends are achieved when both phases have similar characteristics such as melt viscosity. See D.R. Paul, "Fibers From Polymer Blends" in *Polymer Blends*, vol. 2, pp. 167–217 at 184 (D.R. Paul & S. Newman, ehs., Academic Press 1978).

Organophosphites such as triphenylphosphites are known to cause reaction of certain polymer blends such as nylon 6/nylon 66, nylon 6/poly(ethylene terephthalates) and nylon 6/poly(butylene terephthalate) to form graft or block copolymers which can be spun into fibers. For example, U.S. Pat. No. 4,417,031, and S. Aharoni, Polymer Bulletin, vol. 10, pp. 210–214 (1983) disclose a process for preparing block and/or graft co-polymers by forming an intimate mixture of two or more polymers at least one of which includes one or more amino functions, as for example a nylon, and at least one of the remaining polymers includes one or more carboxylic acid functions, as for example a polyester, and a phosphite compound; and thereafter heating the intimate mixture to form the desired block and/or graft copolymers. U.S. Pat. No. 4,417,031 discloses that such copolymers can be spun into fibers.

SUMMARY OF THE INVENTION

It has been discovered that superior polyamide/-polyester graft copolymer fibers can be prepared by mixing a "derivatized polyester component" with a polyamide of fiber-forming molecular weight under conditions sufficient to graft all or a portion of the derivatized polyester component onto the polyamide, and spinning the mixture. Accordingly, a first form of the present invention includes a process for forming polyamide/polyester graft copolymer fibers rich in polyamide, wherein the polyamide and polyester are each melt processible and of fiber-forming molecular weight, which comprises the steps:

(a) intimately mixing in the melt a "derivatized polyester component" selected from the group consisting of:

(i) a polyester containing aromatic or cycloaliphatic diacyl moieties, aliphatic or cycloaliphatic dioxy moieties and aryl ester end-groups of the formula —C-(O)—OR wherein R is aryl or alkylaryl; and (ii) a polyester component prepared by "masterbatching" a polyester containing aromatic or cycloaliphatic diacyl moieties, aliphatic or cycloaliphatic dioxy moieties and carboxy end-groups and "an effective amount" of one or more phosphite compounds for a time and at a temperature sufficient to esterify all or a portion of the carboxy end-groups of said polyester, with the polyamide in proportions giving a continuous polyamide phase, and for a time and at a temperature sufficient to graft a substantial proportion of the esterified carboxy end-groups onto the polyamide;

(b) spinning the grafted mixture of step (b) into a fiber; and (c) drawing the spun fiber.

In a second form, the present invention includes polyamide/polyester graft copolymer fibers comprising:

(a) polyester microfibriles extending in the direction of fiber length, the polyester containing aromatic or cycloaliphatic diacyl moieties and aliphatic or cycloaliphatic dioxy moieties, and (b) a polyamide phase which is continuous in a cross-section of the fiber, a portion of the polyamide being grafted onto the polyester microfibriles such that extracting the fiber with trifluoroethanol or trifluoroethanol/chloroform (2:1 by volume) under conditions sufficient to extract ungrafted polyamide leaves polyamide material coating the polyester microfibriles.

It is believed that the polyamide grafted onto the polyester microfibriles stabilizes the interface between the two phases during the spinning and stretching steps of the present process and thus helps preserve the fine dispersion of polyester microfibriles in the product fiber. It is further believed that the process of the present invention is superior in achieving good fiber properties compared to a process of reacting phosphite, polyester and polyamide simultaneously, and then spinning the resultant graft or block copolymers into a fiber.

DESCRIPTION OF THE PREFERRED EMBODIMENTS OF THE INVENTION

In the first step of the process of this invention, a "derivatized polyester component" is intimately mixed in the melt with a polyamide in proportions sufficient to provide a continuous polyamide phase, and at a temperature and for a time sufficient to graft all or a portion of the polyester component onto the polyamide. The manner in which the polyester and polyamide components are intimately mixed in the melt can vary widely and is not critical. However, the control of the molecular weight of both the polyester and polyamide is important to maintaining sufficient compatibility for intimate mixing in view of competing reactions in addition to the desired grafting reaction. Illustrative of these competing reactions are thermal degradation of the polyester, chain extensions of the polyester and chain extensions of the polyamide. The components can be mixed at room temperature and thereafter heated to the melting point of one of the polymer components and mixed further to form an intimate mixture of the polyamide and the polyester, or either the polyester or polyamide can be heated to a temperature above its melting point and thereafter the other polymer added and mixed with the melted polymer to form an intimate mixture. In a preferred embodiment of this invention, a molten mixture is formed in the first process step. As used herein, "molten mixture" is an intimate mixture which has been heated to a temperature which is equal to or greater than the melting point of at least one of the polymer components of the mixture. The manner in which the molten mixture is formed is not critical and conventional methods can be employed. For example, the molten mixture can be formed through use of conventional polymer and additive blending means, in which the polymeric components are heated to a temperature equal to or greater than the melting point of at least one of the polymers, and below the degradation temperature of each of the polymers. In the particularly preferred embodiments of this invention, the polymers are heated above the melting point of all the polymers in the mixture. Heating is continued until the desired graft copolymers are formed.

In the most preferred embodiment, the components of the intimate mixture can be granulated, and the granulated components mixed dry in a suitable mixer, as for example a tumbler or the like, as uniformly as possible. Thereafter, the composition is heated in an extruder until the polymer components are melted. As described above, the mixture is heated until the desired degree of avidation has been attained. The polyester/polyamide graft polymer can be solidified and used later or can be maintained in melted form and used in the next step of the process.

Temperature can be varied over a wide range. However, it should be appreciated that the process temperature employed in any specific instance will depend on the particular polymers employed and, in the preferred embodiments should be at least as high as the melting point of the polymers and below the degradation temperature of the polymers. In the preferred embodiments of this invention, the process temperature is such that the polymer will remain in the molten state as the block, and/or graft copolymers are formed and is usually at least about 200° C. Normally this can be accomplished in one of two ways. Either the process can be carried out at a temperature which is equal to or greater than the melting point of the desired product; or process temperatures can be increased periodically over the course of the conduct of the process so as to maintain the mixture in the molten state. In the particularly preferred embodiments of this invention employing particularly preferred polymer compositions, the process temperature is from about 220° C. to about 350° C. Amongst these particularly preferred embodiments, most preferred process temperatures are in the range of from about 250° C. to about 300° C.

Similarly, process pressures are not critical and can be varied widely without adversely affecting the process. Consequently, the process can be conducted at sub-atmospheric, atmospheric or super-atmospheric pressures. However, for convenience the process is carried out at atmospheric or autogeneous pressure.

The process is carried out for a time sufficient to form the desired block, and/or graft copolymers as is indicated by the decrease in the melt index and increase in the viscosity of the mixture. Reaction times can be varied over a wide range. Usually, reaction times will depend on a variety of factors such as the polymeric components, reaction temperatures, and other factors known to those of skill in the art to affect reaction times. In most instances, the reaction time is at least about one second, and usually varies from a few seconds to 24 hours or more. In the preferred embodiments of this invention reaction times will vary from about 1 minute to about 2 hours and in the particularly preferred embodiments from about 2 minutes to about 30 to 60 minutes.

The amount of the derivatized polyester component added to the polyamide can vary widely. In general, the amount is from about 5 to about 90% by weight based on the total weight of the mixture. In the preferred embodiments, the amount is from about 10 to about 45 weight percent, and in the particularly preferred embodiments is from about 12 to about 30 weight percent based on the total weight of the mixture. Amongst these particularly preferred embodiments, most preferred are those embodiments in which the amount of derivatized polyester component added to the polyamide is from about 15 to about 25 weight percent on the aforementioned basis.

Best results are obtained when the process of this invention is carried out in the presence of as little water as possible. Ideally, the conditions will be anhydrous, and this represents the most preferred embodiment of the invention. However, good results can be obtained when as much as 0.165 weight percent water based on the total weight of the mixture is present therein. In the preferred embodiments, the weight percent of water is less than about 0.1 weight percent, and in the particularly preferred embodiments, the weight percent of water is less than about 0.05 weight percent on the same basis.

Illustrative of polyamides which may be utilized in the process of this invention are synthetic linear polycarbonamides characterized by the presence of recurring carbonamide groups as an integral part of the polymer chain which are separated from one another by at least two carbon atoms. Polyamides of this type include polymers, generally known in the art as nylons, obtained from diamines and dibasic acids having the recurring unit represented by the general formula:

$$-NHCORCONHR^1$$

in which R is an alkylene group of at least two carbon atoms, preferably from 2 to 10; and $R^1$ is selected from alkyl and phenyl groups. Also, included are copolyamides and terpolyamides obtained by known methods, as for example, by condensation of hexamethylene diamine and a mixture of dibasic acids consisting of terephthalic acid and adipic acid. In addition to the above polyamides, also useful are polyamides obtained from amino acids and derivatives thereof as for example lactams.

Polyamides of the above description are well-known in the art and include, for example, the copolyamide of 30% hexamethylene diammonium isophthalate and 70% hexamethylene diammonium adipate, the copolyamides of up to 30% bis-(-amidoclyclohexyl) methylene, terephthalic acid and caprolactam, copolyamides of butyrolactam and caprolactam, copolyamides of hexamethalene adipamide and caprolactam, polyhexamethylene adipamide (nylon 66), poly(butyrolactam)(nylon 4), poly(9-aminononanoic acid) nylon 9), poly(enantholactam) (nylon 7), poly(capryllactam) (nylon 8), polycaprolactam (nylon 6), poly(p-phenylene terephthalamide), polyhexamethylene sebacamide (nylon 610), polyaminoundecanamide (nylon 11), polydodecanolactam (nylon 12), polyhexamethylene isophthalamide, polyhexamethylene terephthalamide, polycaproamide, or combinations thereof. The polyamide for use in the most preferred embodiments of this invention is polycaprolactam which is commercially available from Allied Corporation under the tradename Capron TM Nylon.

Polyesters which may be employed in the process of this invention are linear polyesters having aromatic or cycloaliphatic diacyl moieties and aliphatic or cycloaliphatic dioxy moieities. The type of polyester is not critical and the particular polyester chosen for use in any particular situation will depend essentially on the physical properties and features, i.e. flexibility, hardness, toughness, desired in the final shaped article of manufacture. Thus, a multiplicity of linear thermoplastic polyesters having wide variations in physical properties are suitable for use in the process of this invention.

The particular polyester chosen for use can be a homo-polyester or a co-polyester, or mixtures thereof as desired. Polyesters are normally prepared by the condensation of an organic dicarboxylic acid and an organic diol, and, therefore, illustrative examples of useful polyesters will be described hereinbelow in terms of these diol and dicarboxylic acid precursors.

Polyesters which are suitable for use in this invention are those which are derived from the condensation of aromatic, cycloaliphatic, and aliphatic diols with aliphatic, aromatic and cycloaliphatic dicarboxylic acids. Illustrative of useful aromatic diols, are those having from about 6 to about 12 carbon atoms. Such aromatic diols include bis-(n-hydroxyphenyl) ether; bis-(p-hydroxyphenyl) thioether; (bis-(p-hydroxyphenyl)sulphone; (bis-(p-hydroxyphenyl)-methane; 1,2-(bis-(p-hydroxyphenyl)-ethane; 1-phenyl-(bis-(p-hydroxyphenyl)methane; diphenyl-(bis(-p-hydroxyphenyl)-methane; 2,2-bis(4'-hydroxy-3'-dimethylphenyl)propane; 1,1- or 2,2-(bis(p-hydroxyphenyl)-butane; 1,1-dichloro-or 1,1,1-trichloro-2,2-(bis-(p-hydroxyphenyl)-ethane; 1,1-(bis-(p-hydroxyphenyl)-cyclopentane; 2,2-(bis-(p-hydroxy-phenyl)-propane (bisphenol C); p-xylene glycol; 2,5-dichloro-p-xylylene glycol; p-cylenediol; and the like.

Suitable cycloaliphatic diols include those having from about 5 to about 8 carbon atoms. Exemplary of such useful cycloaliphatic diols are 1,4-dihydroxy cyclohexane; 1,4-dihydroxy methylcyclohexane; 1,3-dihydroxycyclopentane; 1,5-dihydroxycycloheptane; 1,5-dihydroxycyclooctane; 1,4-cyclo-hexane dimethanol; and the like. Polyesters which are derived from aliphatic diols are preferred for use in this invention. Useful and preferred aliphatic diols include those having from about 2 to about 12 carbon atoms, with those having from about 2 to about 6 carbon atom being particularly preferred. Illustrative of such preferred diol precursors are 1,2-propylene glycol, 1,3-propylene glycol, ethylene glycol, neopentyl glycol, pentyl glycol, 1,6-hexanediol, 1,4-butanediol and geometrical isomers thereof, diethylene glycol, triethylene glycol, and tetraethylene glycol. Propylene glycol, ethylene glycol and 1,4-butanediol are particularly preferred as diol precursors of polyesters for use in the conduct of this invention.

Suitable dicarboxylic acids for use as precursors in the preparation of useful polyesters are linear and branched chain saturated aliphatic dicarboxylic acids, aromatic dicarboxylic acids and cycloaliphatic dicarboxylic acids. Illustrative of aliphatic dicarboxylic acids which can be used in this invention are those having from about 2 to about 50 carbon atoms, as for example, oxalic acid, malonic acid, dimethylmalonic acid, succinic acid, octadecylsuccinic acid, pimelic acid, adipic acid, trimethyladipic acid, sebacic acid, suberic acid, azelaic acid and dimeric acids (dimerisation products of unsaturated aliphatic carboxylic acids such as oleic acid) and alkylated malonic and succinic acids, such as octadecylsuccinic acid, and the like.

Illustrative of suitable cycloaliphatic dicarboxylic acids are those having from about 6 to about 15 carbon atoms. Such useful cycloaliphatic dicarboxylic acids include 1,3-cyclobutanedicarboxylic acid, 1,2-cyclopentanedicarboxylic acid, 1,3- and 1,4-cyclohexanedicarboxylic acid, 1,3- and 1,4-dicarboxymethylcyclohexane and 4,4'-dicyclohexyldicarboxylic acid, and the like.

Polyester compounds prepared from the condensation of a diol and an aromatic dicarboxylic acid are preferred for use in this invention. Illustrative of such useful aromatic carboxylic acids are terephthalic acid, isophthalic acid and a o-phthalic acid, 1,3-, 1,4-, 2,6 or 2,7-naphthalenedicarboxylic acid, 4,4'-diphenyldicarboxylic acid, 4,4'-diphenylsulphone-dicarboxylic acid, 1,1,3-trimethyl-5-carboxy-3-(p-carboxy-phenyl)indane, diphenyl ether 4,4'-dicarboxylic acid bisp(carboxyphenyl)methane and the like. Of the aforementioned aromatic dicarboxylic acid, isophthalic acid and terephthalic acid are preferred for use. Amongst these preferred acid precursors, terephthalic acid is particularly preferred.

In the most preferred embodiments of this invention, poly(ethylene terephthalate), poly(butylene terephthalate), and poly(1,4-cyclohexane dimethylene terephthalate), are the polyesters of choice. Among these polyesters of choice, poly(ethylene terephthalate) is most preferred.

The polyesters employed in the conduct of the process of this invention have derivatized end groups. One type of polyester useful in the conduct of this invention has aryl ester end groups of the formula:

$$-\overset{\overset{\displaystyle O}{\|}}{C}OR$$

wherein R is aryl or alkylaryl. Such derivatized polyesters can be conveniently prepared by terminating the chain(s) of the polyester by introducing monovalent aryl alcohols of the general formula R—OH, where R is as described above. This procedure is described in more detail in general terms in W.R. Sorenson and T.W. Campbell "Preparative Methods in Polymer Chemistry" published by Interscience, NY, NY (1968), which is incorporated herein by reference.

The second and preferred form of derivatized polyester is prepared by masterbatching in the melt a polyester containing aromatic or cycloaliphatic diacyl moieties, aliphatic or cycloaliphatic dioxy moieties and carboxy end groups, and "an effective amount" of one or more phosphite esters or symmetrical or asymmetrical polyphosphite ester having more than one phosphite moiety wherein each moiety contains a substituted or unsubstituted phenyl group, for a time sufficient to esterify all or a portion of said carboxy end groups. Procedures employed in the masterbatching step are essentially the same as employed in the first step of the process of this invention.

Useful phosphite esters, and phosphite esters containing more than one phosphite ester moiety linked by a divalent aliphatic or aromatic moiety in which each phosphite ester moiety is substituted with at least one substituted or unsubstituted aromatic group are known compounds. Such compounds can be conveniently prepared by reacting phosphorus trichloride and one or more alcohols at least one of which is an aromatic alcohol. For example, triphenyl phosphite can be prepared by reacting three moles of phenol with one mole of phosphorus chloride, and trisnonyl phenol phosphite can be prepared by reacting three moles of trisnonyl phenol with one mole of phosphorus chloride. Mixed phosphites such as diphenyl isodecyl phosphite, diphenyl isooctyl phosphite and phenyl diisodecyl phosphite, can be prepared by reacting an appropriate mixture of aromatic and aliphatic alcohols with phosphorus trichloride. Similarly, useful phosphites containing more than one phosphite ester moiety can be prepared by reacting aromatic and aliphatic alcohols at least one of which is polyhydric with phosphorus trichloride.

Illustrative of useful phosphite esters are compounds of the formula:

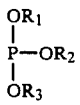

and asymmetrical and symmetrical phosphite derivatives thereof having more than one phosphite ester moiety wherein:

$R_1$, $R_2$ and $R_3$ are the same or different and are hydrogen, metal cations, ammonium radicals, or substituted or unsubstituted phenyl or alkyl wherein permissible substituents are one or more of alkyl, alkoxy, cyano, nitro or halo groups, or $R_1$, $R_2$ and $R_3$ individually may form a moiety of the formula:

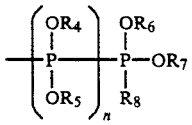

wherein n is 0 or a positive whole number, and $R_4$, $R_5$, $R_6$, $R_7$ and $R_8$ are the same or different and are $R_1$, $R_2$ and $R_3$.

Illustrative of permissible $R_1$, $R_2$ and $R_3$ groups are aliphatic groups such as t-butyl, n-butyl, isopropyl, hexyl, pentyl, 2-chloroethyl, neopentyl, decyl, dodecyl, isodecyl, butoxyethyl, 3-chlorobutyl and the like; aromatic groups such as 3,5-di-tert-butylphenyl, 4-tert-butylphenyl, 3-isopropylphenyl, 2,4-dimethylphenyl, nonylphenyl, octylphenyl, 4-chlorophenyl, 2,4-dibromophenyl, 4-fluorophenyl, 3,5-dichlorophenyl, 4-cyanophenyl, 2-nitrophenyl and the like; and groups containing one or more phosphite moieties, as for example, ethylene diphenyl phosphite, or a poly(dipropylene glycol) phenyl phosphite moiety bonded to the oxygen atom via the dipropylene glycol moiety.

Illustrative of useful phosphite esters are triphenyl phosphite, diphenyl phosphite, tris(nonylphenyl) phosphite, di-phenyl isodecyl phosphite, phenyl diisodecyl phosphite, diphenyl isooctyl phosphite, phenyl diisodecyl phosphite, poly(dipropylene glycol) phenyl phosphite, poly(4,4'-isopropylidene diphenol neopentyl alcohol phosphite), bis-(2,4-di-t-butylphenyl)-pentaerythritol diphosphite, and tris-(2,4-di-t-butylphenyl) phosphite.

An effective amount of one or more phosphite compounds is employed in forming the masterbatch. As used herein, "an effective amount" is an amount of the phosphite compounds which when added to the polymeric component in accordance with this invention forms a mixture which when heated forms the desired block and/or graft copolymers. In the preferred embodiments of this invention, the quantity of the one or more phosphite ester employed is at least about 0.05 weight percent, based on the total weight of the mixture. In the particularly preferred embodiments of this invention, the weight percent of phosphite ester is in the range of from 0.1 to about 10 weight percent, and amongst these particularly preferred embodiments, those in which the quantity of phosphite ester employed is from about 0.2 to about 2 weight percent based on the total weight of the mixture are most preferred.

Process temperature used in the masterbatching step can be varied over a wide range. However, it should be appreciated that the process temperature employed in any specific instance will depend on the particular polymer or polymers employed and, in the preferred embodiments should be at least as high as the melting point of the polymers and below the degradation temperature of the polymers. In the preferred embodiments of this invention, the process temperature is such that the polymer will remain in the molten state during masterbatching. In the particularly preferred embodiments of this invention employing particularly preferred polymer compositions, the process temperature is at least about 150° C. Amongst these particularly preferred embodiments, most preferred process temperatures are in the range of from about 200° C. to about 300° C.

Similarly, process pressures are not critical and can be varied widely without adversely affecting the process. Consequently, the process can be conducted at sub-atmospheric, atmospheric or super-atmospheric pressures. However, for convenience the process is carried out at atmospheric or autogeneous pressure.

The masterbatching is carried out for a time sufficient to form the desired number of esterfied endgroups. Reaction times can be varied over a wide range. Usually reaction times will depend on a variety of factors such as the polymeric components, reaction temperatures, phosphite component and its concentration, and other factors known to those of skill in the art to affect reaction times. In most instances, the reaction time can vary from a few seconds to three hours or more. In the preferred embodiments of this invention reaction times will vary from about 1 min. to about 2 hours and in the particularly preferred embodiments from about 2 min. to about 30 to 60 min.

In the second and third steps of the process of the invention, the grafted mixture is spun into a fiber and the spun fiber is drawn using conventional techniques well known to those of skill in the art and will not be described herein in great detail. Illustrative of such useful techniques are those described in detail in "Man-Made Fibers, Science and Technology", vols. 1–3, H.F. Mark, S.M. Atlas, E. Cerdia, Eds. (Interscience, N.Y., 1967) and "Polymer Blends", vol. 2, Chapter 16, D.R. Paul, S. Newman, Eds. (Academic Press, New York, 1978).

The process of this invention provides graft and/or block polymer compositions having decreased melt indices and increased viscosities. Such polymers are extremely useful as tire cord in pneumatic tires, and the products, filaments, fibers and yarn produced therewith have significantly better properties than other polymers. For example, the fibers have increased tenacity, greater breaking strength and greater resistance to depolymerization. When yarn produced from a block and/or graft copolymer prepared by the process of this invention is made into tire cord and the cord is then used for pneumatic tire reinforcement, the life span of the tire is markedly increased over that of tires reinforced with cord made from other polymers.

The following specific example is presented to more particularly illustrate the invention, and should not be construed as being limitations on the scope and spirit of the invention.

EXAMPLE I

General Procedure

A series of experiments were carried out to demonstrate the effectiveness of the process of this invention in the production of polyamide/polyester graft copolymers which are useful in the manufacture of yarn. In these experiments, a polyester of intrinsic viscosity of 0.68–0.70 dL/g in phenol/tetrachloroethane solvent mixture and having about equal number of carboxyl and hydroxyl chain end-groups, is dried in pellet form in a vacuum oven maintaining 1.0 mm Hg pressure or less at 155 ±5° C. for about 16 hours prior to all subsequent handling. The dried, weighed pellets are transferred immediately to hermetrically sealed glass jars where they are allowed to cool to room temperature. Based on the weight of the polyester, there are added 1.5 wt/wt% triphenyl phosphite to the polyester in the jars, the vessels are immediately sealed to air and humidity, and the phosphite coats the polyester pellets by tumble mixing.

The tumble-mixed polyester/phosphite mixture was then extruded at nominal barrel temperature of 285° C. ±5° C. in a single screw Wayne extruder equipped with an L/d =24, 5:1 single stage mixing screw. The optimal residence time was found to be 150 seconds. The extrudate was passed through a room temperature water trough for cooling from whence it transferred to a chopping machine in which the strand was pelletized. The collected pellets of the polyester containing the phosphite ("Polyester Masterbatch" or "M.B.") were dried in a vacuum oven as before but at a temperature of only 120° C. At this point the M.B. is ready for mixing with the desired polyamide. Precalculated amounts of the pelletized polyamide were dried in the vacuum oven at ~110° C. for not less than 4 hours. Then the dried polyamide was tumble-mixed in hermetically closed glass jars with premeasured amounts of the M.B. The mixture was then fed through a nitrogen-blanketed hopper into a Sterling extruder equipped with a L/d =4 metering screw, followed by a Koch static mixer with L/d ≧4 and wave amplitudes of either ⅛" or 1/16". After emitting from the static mixer, the polymeric melt passes through a metering pump maintaining uniform pressure on the polymer melt pool residing on top of a screen pack nestled right on the spinnerette. The exact nominal temperature profile depends on the exact molecular weight of the polyamide (and its melt viscosity) on the molecular weight of the M.B. (as reflected by its intrinsic viscosity) and on the ratio of polyamide MB in the mixture. The temperature range along the extruder barrel is 254–288° C. and about 11–22° C. higher at the spinnerette.

The shape of the spinnerette reflects the anticipated end-use of the fibers: round holes for industrial or tire-cord end-use, and trilubal holes for carpets, etc. After passing through the spinnerette, the molten polymer mixture drops down a stack and is partially drawn into fine fibers prior to be taken up on the takeup roll of a Lessona drawing machine. From the take-up roll the fibers move to a pick up bobbin for the purpose of time-lagging prior to the final drawing, or are drawn immediately to the desired draw ratio by passing through a sequence of rolls each rotating at higher rpm and each maintained at a different temperature. The desired draw ratio for industrial yarn is about 5:1 and for carpeting purpose it is 3:1. Independently of whether the fibers were spun-drawn or spun-fine lagged-drawn, the cross-section of the M.B. microfibrils in the polyamide matrix of each of the filaments in the yarn, was observed by transmission electron microscopy (TEM) and scanning electron microscopy (SEM) to be about 2000A and less.

Grafting of polyamide onto the PET microfibrils was detected by the following two procedures: nylon-6 is fully soluble in trifluoroethanol (TFE) in a matter of hours at room temperature and within minutes at reflux temperature nylon-6, nylon-66 and nylon-12 are highly soluble in 2:1 or 3:2 vol/vol TFE/$CHCl_3$, with complete solubility effected much faster than in TFE above. Yarn containing nylon-6/polyamide was placed in a large excess of TFE or TFE/$CHCl_3$ with agitation and stirred until the yarn fell apart and most of the material dissolved. The suspension was centrifuged at least 35000G and the solids filtered off. These solids were again placed in the polyamide solvent and the process thus repeated three times. In the last time, the suspension was heated for 45 minutes at not lower than 50° C. prior to centrifugation and filtration. The solids were then collected and submitted to SEM observation, titrations for amine and carboxyl end groups and nitrogen elemental analysis to determine the extent of grafting.

The results of the experiments with their initial modulus (all in units of grams per denier) and with specific remarks, are listed in Table I below. In Table I, the following abbreviations have the following meanings:

(a) "LSB" is a nylon-6 having about an equal number of carboxyl and amine end-groups and having an average molecular weight of 39,200

(b) "BHS" is a nylon-6 having about an equal number of carboxyl and amine end-groups and having an average molecular weight of 45,780

(c) "PET MB" is masterbatched poly(ethylene terephthalate)

(d) "TPP" is triphenylphosphite (e) "PET" is poly(ethylene terephthalate which does not include a phosphite (f) "PBT MB" is masterbatched poly(butylene terephthalate)

(g) "PBT" is poly(butylene terephthalate which does not include a phosphite (h) "KODAR MB" is masterbatched poly(tereisophthalate)cyclohexane dimethane (i) "KODAR" is poly(tereisophthalate)cyclohexane dimethanol which does not include a phosphite (j) "TBP" is tributylphosphite (k) "C" prior to the experiment number indicates that the experiment is included for comparative purposes (l) "N-12" is nylon 12 having an average molecular weight (Mn) of about 12,000

(m) "N-66" is nylon 66 having an average molecular weight (Mn) of about 24,000

(n) "-" indicates that fiber could not be spun from the polymer or that a material was not added (o) "A" indicates high graft (p) "B" indicates moderate graft (q) "C" indicates low or no graft (r) "NA" indicates that graft polymer could not be drawn.

TABLE I

| Exp No. | Yarn Composition | Barrel Temp. °C. | Draw Ratio | Initial Modulus g/den. | Graft |
|---|---|---|---|---|---|
| C1 | LSB (Control) | 265.6 | 3:1 | 20.4 | — |
| C2 | LSB (Control) | 265.6 | 3:1 | 24.2 | — |
| C3 | LSB (Control) | 265.6 | — | — | — |
| C4 | LSB (Control) | 265.6 | — | — | — |
| C5 | LSB (Control) | 282 | — | — | — |
| 6 | LSB/15% PET M.B. | 282 | 3:1 | 32.9 | B |
| 7 | LSB/15% PET M.B. | 282 | 3:1 | 34.9 | B |
| 8 | LSB/15% PET M.B. | 282 | 3:1 | 46.2 | A |
| C9 | LSB (Control) | 265.6 | 4.5:1 | 46.4 | C |
| 10 | LSB/15% PET M.B. | 282 | 4.4:1 | 66.5 | A |
| 11 | LSB/15% PET M.B. | 282 | 4.7:1 | 67.2 | A |
| 12 | LSB/15% PET M.B. | 282 | 3.9:1 | 65.7 | A |
| C13 | LSB (Control) | 265.6 | 3:1 | 21.8 | C |
| 14 | LSB/15% PET M.B. | 282 | 3:1 | 49.8 | A |
| 15 | LSB/15% PET M.B. | 282 | 3:1 | 41.3 | A |
| C16 | LSB (Control) | 265.6 | 3:1 | 19.2 | C |
| C17 | LSB (Control) | 265.6 | 3:1 | 24.2 | C |
| 18 | LSB/15% PET M.B. | 287.8 | 3:1 | 30.8 | B |
| C19 | LSB/15% PET IV = 0.68 (Control) | 287.8 | 3:1 | 24.1 | C |
| 20 | LSB/15% PET M.B. IV = 0.53 | 282 | 3:1 | 30.4 | B |
| 21 | LSB/15% PET M.B. IV = 0.68 | 282 | 3:1 | 29.0 | B |
| 22 | LSB/15% PET M.B. IV = 0.95 | 282 | 3:1 | 30.2 | B |
| C23 | LSB/15% PET (Control) | 276.7 | 3:1 | 22.8 | C |
| C24 | LSB/15% PET (Control) | 276.7 | 3:1 | 26.4 | C |
| C25 | LSB (Control) | 254 | 3:1 | 18.5 | C |
| 26 | LSB/15% PET M.B. | 282 | 3:1 | 40.8 | A |
| 27 | LSB/15% PET M.B. | 282 | 3:1 | 43.1 | A |
| C28 | LSB/30% PET M.B. | 254 | 3:1 | 26.2 | C |
| C29 | LSB/30% PET M.B. | 254 | 3:1 | 29.4 | C |
| 30 | LSB/30% PET M.B. | 271 | 3:1 | 40.7 | A |
| 31 | LSB/30% PET M.B. | 271 | 3:1 | 42.0 | A |
| 32 | LSB/30% PET M.B. | 287.8 | 3:1 | 36.5 | A |
| 33 | LSB/30% PET M.B. | 296 | 3:1 | 35.9 | A |
| 34 | LSB/30% PET M.B. | 296 | 3:1 | 42.4 | A |
| 35 | LSB/30% PET M.B. | 290.6 | 3:1 | 44.1 | A |
| 36 | LSB/30% PET M.B. | 282 | 3:1 | 36.8 | A |

TABLE I-continued

| Exp No. | Yarn Composition | Barrel Temp. °C. | Draw Ratio | Initial Modulus g/den. | Graft |
|---|---|---|---|---|---|
| 37 | LSB/45% PET M.B. | 265.6 | 3:1 | 52.7 | A |
| 38 | LSB/45% PET M.B. | 265.6 | 3:1 | 59.3 | A |
| 39 | LSB/5% PET M.B. | 271 | 3:1 | 22.5 | A |
| 40 | LSB/10% PET M.B. | 271 | 3:1 | 37.0 | A |
| 41 | LSB/15% PET M.B. | 282 | 3:1 | 37.5 | A |
| 42 | BHS/15% PET M.B. | 293 | 5:1 | 59.8 | A |
| 43 | BHS/15% PET M.B. | 290.6 | 5:1 | 60.9 | A |
| 44 | BHS/15% PET M.B. | 287.8 | 4.6:1 | 48.8 | A |
| 45 | BHS/15% PET M.B. | 282 | 5:1 | 65.6 | A |
| 46 | BHS/30% PET M.B. | 287.8 | 2.2:1 | 23.9 | A |
| 47 | BHS/30% PET M.B. | 287.8 | 2.3:1 | 27.8 | A |
| 48 | BHS/45% PET M.B. | 276.7 | 5:1 | 63.9 | A |
| 49 | BHS/45% PET M.B. | 276.7 | 5:1 | 63.7 | A |
| 50 | (N-66)/ 15% PET M.B. | 271–282 | 3:1 | 38.6 | A |
| 51 | (N-12)/ 15% PET M.B. | 298.9 | 3:1 | 36.3 | A |
| C52 | LSB (Control) | 265.6 | 3:1 | 20.4 | — |
| 53 | LSB/30% KODAR M.B. | 287.8 | 3:1 | 31.5 | A |
| 54 | LSB/15% KODAR M.B. | 271–293 | 3:1 | 29.8 | A |
| C55 | LSB/10% KODAR (Control) | 287.8 | 3:1 | 18.5 | — |
| 56 | LSB/10% KODAR M.B. | 287.8 | 3:1 | 25.5 | A |
| 57 | LSB/10% KODAR M.B. | 271 | 3:1 | 28.7 | A |
| 58 | LSB/10% KODAR M.B. | 282 | 3:1 | 30.0 | A |
| 59 | LSB/15% PBT/MP | 282 | NA | NA | A |
| 60 | LSB/15% KODAR/MP | 282 | NA | NA | A |
| 61 | LSB/15% PET/MP | 282 | NA | NA | A |

EXAMPLES II to IV

Using the procedure of Example I, and an appropriate selection of polyesters, polyamides, phosphite esters, a wide variety of other graft copolymers can be prepared in accordance with the process of this invention. The process parameters of these illustrative embodiments are set forth in the following Table II.

| Ex. | Polyester | Polyamide | Phosphite Ester |
|---|---|---|---|
| II | Poly(ethylene adipate) | Nylon 4 | Diphenyl phosphite |
| III | Poly(ethylene azelate) | Nylon 66 | Diphenyl isodecyl phosphite |
| IV | Poly(ethylene-1,5-naphthalate) | Nylon 7 | Irisnonylphenyl phosphite |

-continued

| Ex. | Polyester | Polyamide | Phosphite Ester |
|---|---|---|---|
| V | Poly(tetramethylene-isophthalate) | Nylon 6,10 | Diphenyl diisodecyl phosphite |
| VI | Poly(decamethylene adipate) | Nylon 10 | Poly(dipropylene glycol)phenyl phosphite |
| VII | Poly(decamthylene sebacate) | Nylon 9,9 | Diphenyl isodecyl phosphite |
| VIII | Poly(ethylene-2,6-naphthalate) | Nylon 8 | Diphenyl isooctyl phosphite |
| IX | Poly(ethylene oxy-benzoate) | Nylon 10,10 | Triphenyl phosphite |
| X | Poly(tetramethylene terephthalate) | Nylon 9,8 | Bis(2,4-di-t-butyl-phenyl)-pentaerythritol diphosphite |
| XI | Poly(para-hydroxy-benzoate) | Nylon 12 | Diphenylethyl phosphite |
| XII | Poly(1,4-cyclohexyl-idene dimethylene terephthalate) | Nylon 9 | Tris(2,4-di-tert-butylphenyl) phosphite |
| XIII | Poly(tetramethylene isopthalate) | Nylon 7,7 | Tri-o-cresyl phosphite |
| XIV | Poly(hexamethylene terephthalate) | Poly(p-phenylene terephthalamide | Tri-p-cresyl phosphite |
| XV | Poly(decamethylene terephthalate) | Poly(metaphenyleneisophthalamide) | Poly(4,4'-isopropylidene diphenyl neopentyl alcohol) phosphite |
| XVI | Poly(1,4 cyclohexane dimethylene terephthalate | Copolymer of butyrolactam and caprolactam | Trisoctylphenyl phosphite |

What is claimed is:

1. A process for forming polyamide/polyester graft copolymer fibers rich in polyamide, wherein the polyamide and polyester are each melt processible and of fiber-forming molecular weight, which process comprises the steps of:

(a) intimately mixing in the melt a polyamide having amine end groups and a derivatized polyester component selected from the group consisting of:

(a) (i) a polyester component containing recurring aromatic or cycloaliphatic diacyl moieties and aliphatic or cycloaliphatic dioxy moieties in the polymeric backbone and aryl ester end-groups of the formula —C(O)OR wherein R is aryl or alkylaryl; and (ii) a polyester component prepared by masterbatching a polyester containing recurring aromatic or cycloaliphatic diacyl moieties, and aliphatic or cycloaliphatic dioxy moieties in the polymeric backbone and carboxy end-groups and one or more phosphite ester compounds for a time, at a temperature and with an amount of said phosphite ester compounds sufficient to esterify all or a portion of the carboxy end-groups of said polyester, in proportions giving a continuous polyamide phase, and for a time and at a temperature sufficient to graft a substantial proportion of the esterified carboxy end-groups onto the polyamide;

(b) spinning the grafted mixture of step (a) into a fiber; and (c) drawing the spun fiber.

2. The process of claim 1 wherein the polyamide is selected from the group consisting of nylon 6, nylon 66 and nylon 12.

3. The process of claim 2 wherein said polyamide is nylon 6.

4. The process of claim 1 wherein said derivatized polyester is a polyester prepared by masterbatching a polyester containing aromatic or cycloaliphatic diacyl moieties and carboxyl end-groups and one or more phosphite ester compounds for a time at a temperature and with an amount of said phosphite ester compounds sufficient to esterify all or a portion of the carboxyl end-groups.

5. The process of claim 4 wherein the masterbatching temperature is at least about 150° C.

6. The process of claim 10 wherein the masterbatching temperature is about 200° C. to about 300° C.

7. The process of claim 4 wherein the amount of said phosphite ester compounds is at least about 0.05 weight percent based on the total weight of polyester.

8. The process of claim 7 wherein said amount is from about 0.1 to about 10 weight percent.

9. The process of claim 8 wherein said amount is from about 0.2 to about 2 weight percent.

10. The process of claim 4 wherein the amount of masterbatched polyester intimately mixed with the polyamide is from about 5 to about 90 weight percent based on the total weight of the mixture.

11. The process of claim 10 wherein said amount is from about 10 to about 45 weight percent.

12. The process of claim 11 wherein said amount is from about 12 to about 30 weight percent.

13. The process of claim 12 wherein said amount is from about 15 to about 25 weight percent.

14. The process according to claim 1 wherein said polyamide and said polyester component are mixed for at least about 1 sec.

15. The process according to claim 14 wherein the mixing time is from about 1 min. to about 120 min.

16. The process according to claim 15 wherein the mixing time is from about 2 min. to about 60 min.

17. The process of claim 4 wherein said phosphite ester compound is a monophosphite or diphosphite.

18. The process of claim 17 wherein said phosphite ester compound is a monophosphite of the formula

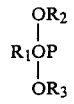

wherein:

$R_1$, $R_2$ and $R_3$ are the same or different and are alkyl, aryl or alkylaryl, with the proviso that at least one of $R_1$, $R_2$ and $R_3$ is aryl or alkylaryl.

19. The process of claim 18 wherein at least two of $R_1$, $R_2$ and $R_3$ are aryl or alkylaryl.

20. The process of claim 18 wherein $R_1$, $R_2$ and $R_3$ are phenyl or alkylphenyl.

21. The process of claim 20 wherein $R_1$, $R_2$ and $R_3$ are phenyl.

22. The process of claim 20 wherein $R_1$, $R_2$ and $R_3$ are alkylphenyl.

23. The process of claim 21 wherein $R_1$, $R_2$ and $R_3$ are nonylphenyl or 2,4-di-tert-butyl phenyl.

24. The process of claim 1 wherein the polyester components of a(i) and a(ii) contain aromatic diacyl moieties.

25. The process of claim 24 wherein said aromatic diacyl moieties are selected from the group consisting of terephthalate and isophthalate moieties.

26. The process of claim 25 wherein said aromatic diacyl moieties are terephthalate moieties.

27. The process of claim 25 wherein said aromatic diacyl moieties are isophthalate moieties.

28. The process of claim 1 wherein the polyester component of a(i) and a(ii) is poly(ethylene terephthalate).

29. The process of claim 1 wherein the polyester component of a(i) and a(ii) is poly(butylene terephthalate).

30. The process of claim 25 wherein the polyester components of a(i) and a(ii) is poly(1,4-cyclohexane dimethylene terephthalate).

31. The process of claim 24 wherein the polyester components of a(i) and a(ii) contain aliphatic dioxy moieties of from about 2 to about 6 carbon atoms.

32. A process for forming polyamide/polyester graft copolymer fibers rich in polyamide, wherein the polyamide and polyester are each melt processible and of fiber-forming molecular weight, which comprises the steps:

(a) intimately mixing in the melt a polyester component prepared by masterbatching a polyester containing aromatic or cycloaliphatic diacyl moieties, aliphatic or cycloaliphatic dioxy moieties and carboxy end-groups and one or more phosphite ester compounds for a time, at a temperature and with an amount of said phosphite ester compound sufficient to esterify all or a portion of the carboxy end-groups of said polyester, with a polyamide having amino end-groups in proportions giving a continuous polyamide phase, and for a time and at a temperature sufficient to graft a substantial proportion of the esterified carboxy end-groups onto the polyamide;

(b) spinning the grafted mixture of step (a) into a fiber; and (c) drawing the spun fiber.

* * * * *